United States Patent [19]

Iwase et al.

[11] Patent Number: 4,833,751

[45] Date of Patent: May 30, 1989

[54] FIXING MEMBER FOR RETAINING LIQUID-APPLICATION MEMBER OF LIQUID APPLICATOR SUCH AS WRITING INSTRUMENT, COSMETIC INSTRUMENT AND THE LIKE

[75] Inventors: Yasuyuki Iwase, Fujioka; Kiyokazu Sakurai, Saitama, both of Japan

[73] Assignee: Mitsubishi Pencil Co., Ltd., Tokyo, Japan

[21] Appl. No.: 36,234

[22] Filed: Apr. 9, 1987

[30] Foreign Application Priority Data

Apr. 10, 1986 [JP] Japan ..... 61-54225[U]

[51] Int. Cl.[4] ..... A46B 3/00; A46B 3/08

[52] U.S. Cl. ..... 15/190; 15/194; 24/541; 24/563; 401/268; 401/290; 403/326; 403/405.1

[58] Field of Search ..... 401/123, 127, 129, 207, 401/251, 259, 260, 273, 268, 290, 291; 15/190, 191 R, 191 A, 159 R, 167.1, 167.2, 167.3, 168, 171, 173, 176, 177, 183, 199, 201, 202, 203, DIG. 4, 194; 24/541, 543, 563; 403/167, 168, 326, 397, 405.1, DIG. 7, 329

[56] References Cited

U.S. PATENT DOCUMENTS

| | | | |
|---|---|---|---|
| 534,011 | 2/1895 | Sampsell | 401/290 X |
| 1,240,944 | 9/1917 | Clay | 401/123 X |
| 1,368,833 | 2/1921 | Piechowicz | 401/207 X |
| 1,725,852 | 8/1929 | Cressler | 15/194 X |
| 1,742,192 | 1/1930 | Bayer | 15/194 |
| 2,680,868 | 6/1954 | Peterson | 401/290 |
| 2,825,080 | 3/1958 | Bongiovanni | 401/290 X |
| 2,865,039 | 12/1958 | Kaye et al. | 15/201 X |
| 3,100,494 | 8/1963 | Littman | 24/563 X |
| 3,682,442 | 8/1972 | Holly | 15/201 X |
| 3,851,435 | 12/1974 | Robert et al. | 403/168 X |
| 3,879,791 | 4/1975 | Isler | 15/201 X |
| 4,461,408 | 7/1984 | Shepard | 401/260 X |
| 4,479,501 | 10/1984 | Chern | 15/186 X |

*Primary Examiner*—Richard J. Apley
*Assistant Examiner*—David J. Bender
*Attorney, Agent, or Firm*—Armstrong, Nikaido Marmelstein Kubovcik & Murray

[57] ABSTRACT

In a liquid applicator provided with a fixing member for retaining a liquid-application member having a fixing flange at its rear end, the liquid-application member and the fixing member are assembled to form an assembly which is mounted inside a front shaft of the liquid applicator through a snap-in packing. Since the fixing member is provided with a resilient clipping-plate portion for compensating any variation of the thickness of the fixing flange of the liquid-application member, assembling of the assembly and the front shaft can be easily conducted in the liquid applicator.

2 Claims, 2 Drawing Sheets

FIXING MEMBER FOR RETAINING LIQUID-APPLICATION MEMBER OF LIQUID APPLICATOR SUCH AS WRITING INSTRUMENT, COSMETIC INSTRUMENT AND THE LIKE

BACKGROUND OF THE INVENTION

1. Field of the Invention

The present invention relates to a fixing member for retaining a liquid-application member such as: a pen core of a writing instrument such as a pen-type writing brush and the like; an application brush of a cosmetic instrument such as a nail-polish applicator; and other application members mounted in a front end portion of a liquid applicator, in a main body of such liquid applicator.

2. Description of the Prior Art

Hitherto, in a method for fixing such kind of the application member to a portion inside a shaft of a liquid applicator, a rear end portion of the application member is thermoformed to form a fixing flange which is engaged with a shoulder portion formed inside the shaft of the liquid applicator and then clamped by the use of a snap-in packing in the shaft so that the application member is fixed to the shaft of the liquid applicator. The above-mentioned method is a general method.

However, the thus formed fixing flange of the application member varies in thickness, and it is hard to produce an application member provided with a fixing flange having a constant thickness. In addition, in assembling of the application member and its counterpart, since the counterpart lacks a means for compensating the variation in thickness of the fixing flange of the application member, it is hard to conduct such assembling. Even if such assembling is accomplished, looseness is often produced in the thus assembled product. These are problems inherent in the conventional case.

SUMMARY OF THE INVENTION

It is an object of the present invention to provide a novel fixing member for retaining a liquid-application member of a liquid applicator such as a writing instrument, a cosmetic instrument and the like, which novel fixing member can compensate variations in thickness of a fixing flange of the liquid-application member even when such fixing flange varies in thickness, so as to facilitate the assembling of the liquid-application member in the liquid applicator.

According to the present invention, there is provided: In a fixing member for retaining a liquid-application member provided with a fixing flange at its rear end employed in a liquid applicator, the improvement wherein, said fixing member is constructed of: a main-body portion provided with an opening portion which is wider than of said liquid-application member while smaller than a width of said fixing flange; and a resilient clipping-plate portion extended from said main-body portion so as to close said opening portion of said main-body portion, and a spacing between at least one part of said resilient clipping-plate portion opposite to said opening portion of said main-body portion and said main-body portion is smaller than a thickness of said fixing flange.

The main-body portion of the fixing member may have a substantially U-shaped construction.

The clipping-plate portion of the fixing member may be bent to assume a convex shape relative to the main-body portion of the fixing member, or may assume a flat plate-like shape provided that the clipping-plate portion is provided with a leaf spring at a predetermined position of its part corresponding to the opening portion of the main-body portion of the fixing member to enable the clipping-plate portion of the fixing member to urge the fixing flange of the liquid-application member.

BRIEF DESCRIPTION OF THE DRAWINGS

The drawings show an embodiment of the present invention, wherein.

DESCRIPTION OF THE PREFERRED EMBODIMENT

Figure 1:
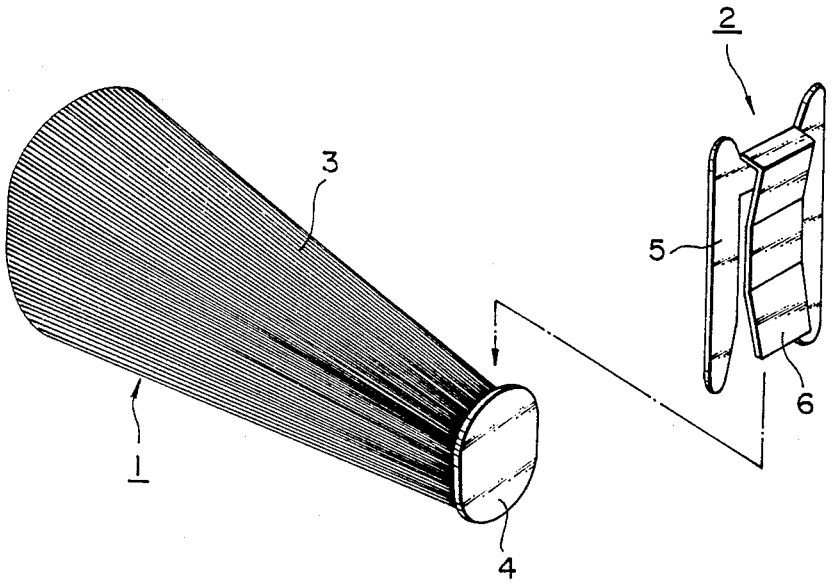
FIG. 1 is a perspective view of the liquid-application member and the fixing member for retaining the liquid-application member in a condition in which they are separated from each other.

The present invention will be described hereinbelow with reference to the drawings illustrating an embodiment of the present invention. It is natural that the present invention is not limited to this embodiment only.

In the drawings, the reference numeral 1 denotes a liquid-application member; and 2 a fixing member for retaining the liquid-application member 1.

FIG. 1 shows a condition in which the liquid-application member 1 and its fixing member 2 are separated from each other before assembling thereof.

Figure 2:
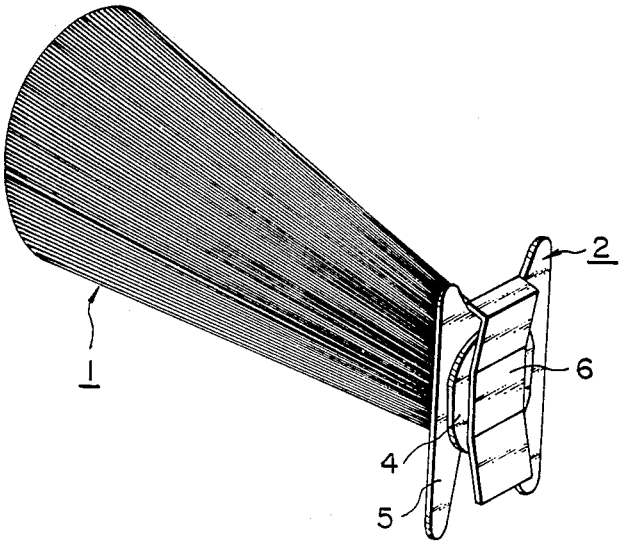
FIG. 2 is a perspective view of an assembly of the liquid-application member and the fixing member thereof.
Figure 3:
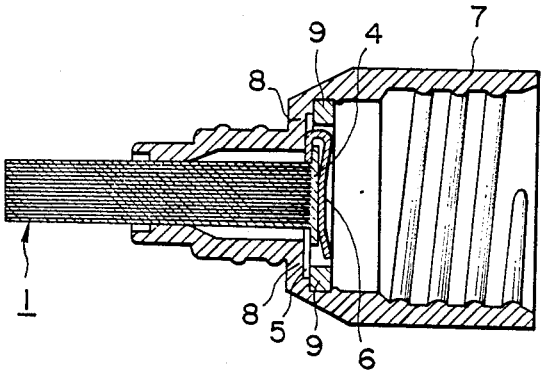
FIG. 3 is a longitudinal sectional view of a front shaft of the liquid applicator, in which the assembly of the liquid-application member and the fixing member thereof is mounted.

The liquid-application member 1 is constructed of a plurality of polyester filaments bundled into a tuft 3 a rear end of which is thermoformed into a fixing flange 4. As shown in FIGS. 1 and 2, the tuft 3 assumes a divergent shape before its assembling. However, after assembling thereof, as shown in FIG. 3, the tuft 3 has a substantially constant diameter over the full length thereof.

The fixing member 2 for retaining the liquid-application member 1 is constructed of a stainless steel plate and provided with a main-body portion 5 having a substantially U-shaped form and a clipping-plate portion 6 which is integrally formed with the main-body portion 5 and extends from a central portion of the main-body portion 5 so as to substantially close a substantially U-shaped opening portion of the main-body portion 5.

The clipping-plate portion 6 of the fixing member 2 is slightly bent inward to assume a convex shape relative to the main-body portion 5 so that a spacing between a top surface of such convex shape of the clipping-plate portion 6 and the main-body portion 5 is smaller than a thickness of the fixing flange 4 of the liquid-application member 1 which is assembled with the fixing member 2. On the other hand, a free end portion of the clipping-plate portion 6 of the fixing member 2 extends outward so as to be separated from the main-body portion 5 of the same 2 in a divergent manner so that a spacing between the free end of the clipping-plate portion 6 and the main-body portion 5 is larger in length than the thickness of the fixing flange 4 of the liquid-application member 1.

An upper and a lower end portions of the main-body portion 5 of the fixing member 2 are shaped into suitable sizes enabling the main-body portion 5 to be received in a clamping shoulder portion provided in a main body of the liquid applicator.

The fixing member 2 may also assume any other suitable shape for preventing the fixing flange 4 of the liquid-application member 1 from dropping out of the fixing member 2, in addition to the U-shaped form.

The fixing member 2 is not restricted in its material, provided that its material is not corroded or deteriorated by the use of an application liquid received in the liquid applicator. In addition, the clipping-plate portion 6 of the fixing member 2 is not necessarily integrally formed with the main-body portion 5 of the same 2 while also not necessarily bent to form the convex shape for urging the fixing flange 4 of the liquid-application member 1 provided that the clipping-plate portion 6 assumes a flat plate-like shape and is provided with a leaf spring at its predetermined portion.

FIG. 2 shows the assembly of the liquid-application member 1 and its fixing member 2. In assembling of the liquid-application member 1 and its fixing member 2, the fixing flange 4 of the liquid-application member 1 is inserted at its neck portion into the opening portion of the main-body portion 5 of the fixing member 2 between the main-body portion 5 and the clipping-plate portion 6 of the fixing member 2. After completion of such assembling, the fixing flange 4 of the liquid-application member 1 is fixed between the main-body portion 5 of the fixing member 2 and the clipping-plate portion 6 of the same 2 under the influence oif an urging force exerted by the clipping-plate portion 6 of the fixing member 2, so that the liquid-application member 1 and its fixing member 2 are integrally assembled.

In the above assembling., since the free end of the clipping-plate portion 6 of the fixing member 2 is outwardly bent so that the spacing between the main-body portion 5 and clipping-plate portion 6 is enlarged, it is possible to easily conduct such assembling.

FIG. 3 shows a condition in which the assembly of the liquid-application member 1 and its fixing member 2 is mounted in the liquid applicator.

As shown in FIG. 3, the assembly of the liquid-application member 1 and its fixing member 2 is inserted into a hollow shaft of the main body of the liquid applicator from a rear end opening portion of a front shaft 7 of the liquid applicator in a condition in which the tuft 3 of the liquid-application member 1 of the assembly is directed forward, until the main-body portion 5 of the fixing member 2 of the assembly abuts on a shoulder portion 8 of the front shaft 7, which shoulder portion 8 is provided inside the front shaft 7 and directed to the rear end opening portion of the front shaft 7. Thereafter, a ring-like snap-in packing 9 is inserted into the front shaft 7 from its rear end opening so that the main body member 5 of fixing member 2 is urged against the shoulder portion 8 by the use of such snap-in packing 9, whereby the assembly of the fixing member 2 and the liquid-application member 1 is fixed to the shoulder portion 8 of the front shaft 7.

Since the present invention has the above-mentioned construction, the fixing flange 4 of the liquid-application member 1 does not serve as a direct medium for fixing the fixing member 2 to the shoulder portion 8 of the front shaft 7 of the liquid applicator and does not directly engage with other component such as the snap-in packing 9 and the like. A component directly engaging with the fixing flange 4 of the liquid-application member 1, i.e., the fixing member 2 clamps the fixing flange 4 by means of its clipping-plate portion 6 which can be resiliently deformed to fix the liquid-application member 1 to the front shaft 7, so that it is possible to easily and surely compensate for the variation of the thickness of the fixing flange 4 of the liquid-application member 1 by use of its resilient fixing member 2. Therefore, any variation of the thickness of the fixing flange 4 of the liquid-application member 1 does not adversely affect the assembling of the assembly 1, 2 and the front shaft 7 in the liquid applicator of the present invention at all.

What is claimed is:

1. In combination with a flange formed at the rear end of the brush tuft for a writing or application instrument, a clip member having a main body member provided with a generally U-shaped opening extending therethrough and wider than the rear end portion of said brush tuft but narrower than said flange; and a clip portion extending from said main body member so as to resiliently close said U-shaped opening with the space between at least a portion of said clip portion and said main body member being less than the thickness of said flange.

2. A combination as claimed in claim 1, wherein said clip portion is a leaf spring having a convex shape with respect to said flange.

* * * * *